US005522110A

United States Patent [19]

Borofsky

[11] Patent Number: 5,522,110

[45] Date of Patent: Jun. 4, 1996

[54] CLEANING APPARATUS

[76] Inventor: Gary R. Borofsky, 1224 Dixon La., Rydal, Pa. 19046

[21] Appl. No.: 443,946

[22] Filed: May 18, 1995

[51] Int. Cl.[6] ..... A47L 13/12; A47L 13/146

[52] U.S. Cl. ..... 15/116.2; 15/115; 15/116.1

[58] Field of Search ..... 15/114, 115, 116.1, 15/116.2, 119.1, 119.2

[56] References Cited

U.S. PATENT DOCUMENTS

| | | | |
|---|---|---|---|
| 2,518,765 | 8/1950 | Ecker | 15/115 |
| 2,701,888 | 2/1955 | Vosbikian et al. | 15/115 |
| 3,157,901 | 11/1964 | Murphy | 15/115 |
| 3,656,202 | 4/1972 | Paton | 15/114 |
| 4,414,700 | 11/1983 | Burns | 15/105 |
| 4,998,314 | 3/1991 | Borofsky | 15/4 |

FOREIGN PATENT DOCUMENTS

| | | | |
|---|---|---|---|
| 1097173 | 6/1955 | France | 15/119.2 |
| 83670 | 8/1964 | France | 15/116.2 |
| 2269318 | 11/1975 | France | 15/114 |
| 730396 | 5/1943 | Germany | 15/115 |

*Primary Examiner*—Mark Spisich

*Attorney, Agent, or Firm*—Panitch Schwarze Jacobs & Nadel

[57] ABSTRACT

A cleaning apparatus comprising a handle and a base member having a first surface and a second surface. The handle is coupled to the first surface and a brush portion is attached to the second surface. The cleaning apparatus further includes an absorbent material portion attached to the second surface of the base member proximate the brush portion, whereby a generally continuous cleaning surface is formed on the second side of the base member by a combination of the brush portion and the absorbent material. A wringer is mounted for pivotal movement with respect to the base member. The wringer can be pivoted from a first, storage position, generally parallel with the handle, to a second position, in which the wringer is substantially parallel with the base member. The wringer is configured to substantially engage and squeeze moisture from the absorbent material without engaging the brush portion.

5 Claims, 3 Drawing Sheets

CLEANING APPARATUS

FIELD OF THE INVENTION

The present invention relates to a cleaning apparatus. More particularly, the present invention relates to a floor mop including a cleaning surface characterized by a brush portion and an absorbent material portion, and a wringer configured to engage and squeeze moisture from the absorbent material portion of the cleaning surface without engaging the brush portion.

BACKGROUND OF THE INVENTION

A variety of manual or hand-held implements have been utilized to facilitate scrubbing and cleaning of flooring. The maintenance of floors, especially tile floors, typically involves cleaning with a wet mop to remove accumulated dirt. One common type of mop for household usage is a sponge mop having a relatively soft, absorbent material, such as an open cell sponge, which can absorb several times its weight in liquid. The sponge mop is typically attached to a handle to allow the user to move the mop across the floor in an efficient manner.

Sponge mops for home usage are often provided with a wringer attachment for removing moisture from the absorbent sponge material to facilitate floor cleaning. In use, cleaning fluid, which typically includes a liquid detergent and water, is placed in an ordinary bucket and the mop is dipped into the bucket to absorb the cleaning fluid. The mop is then withdrawn and moved across the floor to spread the cleaning fluid on the floor. The cleaning fluid loosens or dissolves dirt from the floor surface. The mop is then held over the bucket and wrung with the wringer attachment on the mop to remove excess moisture. The damp mop is then moved across the floor area to absorb the cleaning fluid along with the dissolved dirt from the surface. The mop is then held over the bucket and the wringer attachment is again used to remove moisture from the absorbent material. The process is repeated until the entire floor surface is cleaned.

One problem with the sponge mops is that the soft absorbent material is not sturdy or aggressive enough to effectively clean ground-in dirt. For example, on tile floors a sponge mop does not effectively clean the grout lines between the tiles. Typically, if a floor is only cleaned with a sponge mop, ground-in dirt builds up on the floor surface, or in the case of tile flooring, ground-in dirt builds up in the grout lines and on the tile surfaces. Such ground-in dirt must periodically be removed by hand scrubbing with a brush or other such more aggressive device. Because the floor is only periodically scrubbed, the process for removing the build-up of dirt from the floor surface is labor-intensive.

One solution to this problem is to prevent the dirt from building up on the floor surface by scrubbing the floor on a more regular basis. However, this takes additional time and is labor-intensive.

Another solution to this problem is proposed in Applicant's co-pending application Ser. No. 08/401,735, filed on Mar. 9, 1995, which proposes a mop having a cleaning surface formed from a combination of absorbent material and a brush portion. However, a special bucket wringer adapted to receive the brush portion such that the brush portion remains uncompressed as the water is wrung from the absorbent material is required. However, a separate bucket wringer is often impractical and too costly for home usage.

Accordingly, a need has arisen for providing a self-contained cleaning apparatus for cleaning both smooth and textured surfaces, such as a tile floor, which does not require specialized equipment or substantial additional time for cleaning. The present invention is a result of observation of the disadvantages in the known floor cleaning systems and efforts to overcome them.

SUMMARY OF THE INVENTION

Briefly stated, the present invention is a cleaning apparatus comprising a handle and a base member having a first surface and a second surface. The handle is coupled to the first surface of the base member. A brush portion is attached to the second surface of the base member. The cleaning apparatus further includes an absorbent material portion attached to the second surface of the base member proximate the brush portion, whereby a generally continuous cleaning surface is formed on the second side of the base member by a combination of the brush portion and the absorbent material. A wringer mounted for pivotal movement with respect to the base member is provided. The wringer can be pivoted from a first, storage position, generally parallel with the handle, to a second position, in which the wringer is substantially parallel with the base member. The wringer is configured to substantially engage and squeeze moisture from the absorbent material without engaging the brush portion.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF PREFERRED EMBODIMENTS

Figure 1:
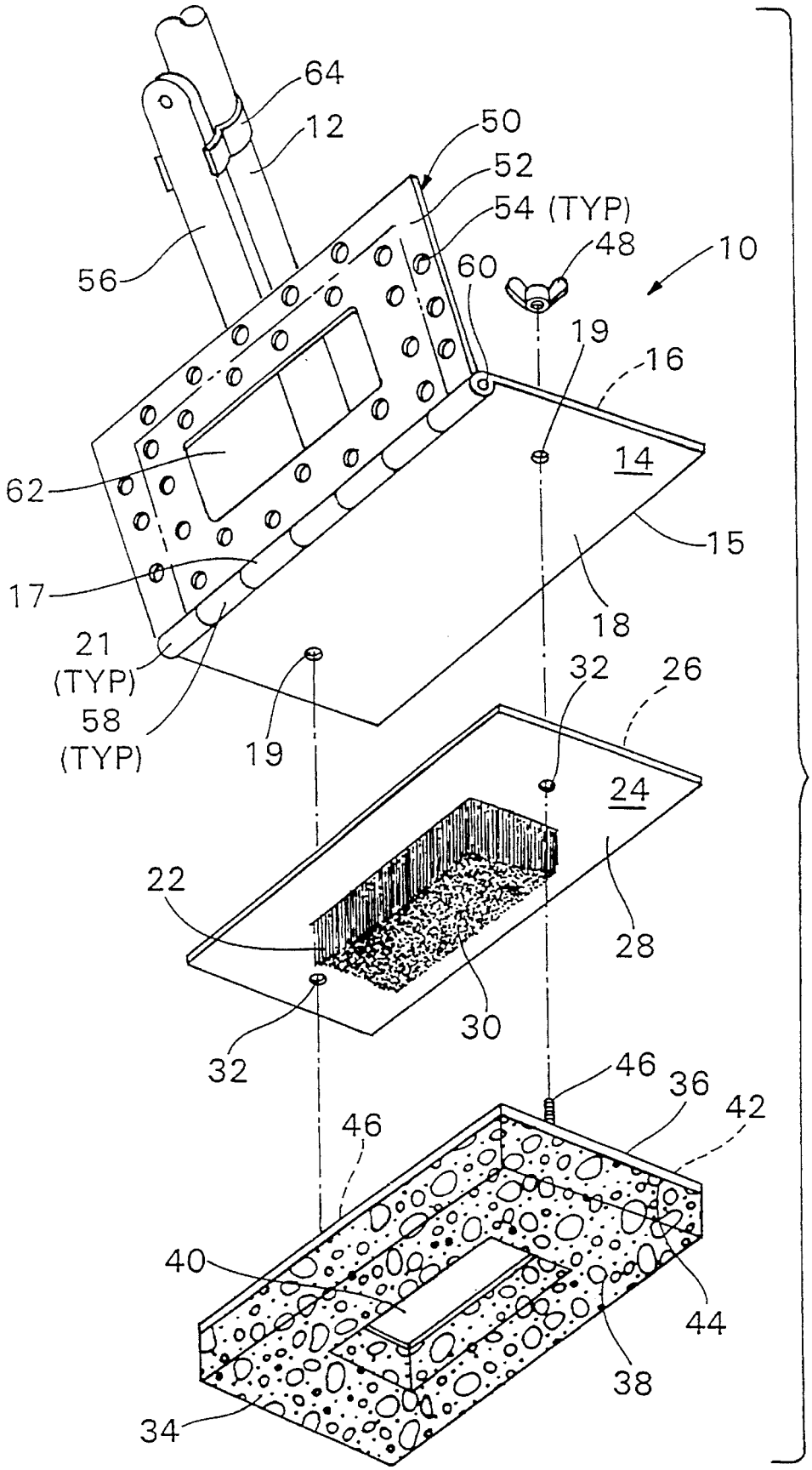
FIG. 1 is an exploded perspective view of a first embodiment of a cleaning apparatus in accordance with the present invention.

Certain terminology is used in the following description for convenience only and is not limiting. The words "right,"

"left," "lower" and "upper" designate directions in the drawings to which reference is made. The words "inwardly" and "outwardly" refer to directions toward and away from, respectively, the geometric center of the cleaning apparatus and designated parts thereof. The terminology includes the words above specifically mentioned, derivatives thereof and words of similar import.

Figure 2:
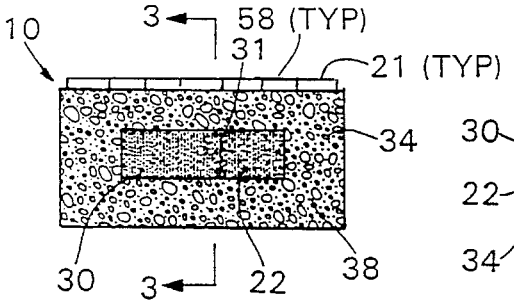
FIG. 2 is a bottom plan view of the cleaning apparatus of FIG. 1.
Figure 3:
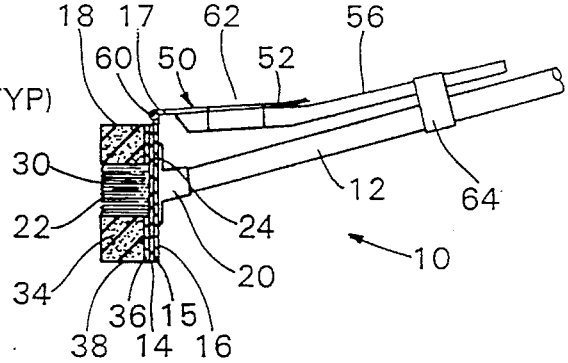
FIG. 3 is a section view taken along line 3—3 in FIG. 2.

Referring to the drawings, wherein like numerals indicate like elements throughout and multiple identical elements in the same figure have been designated as typical (i.e. "TYP"), there is shown in FIGS. 1–3 a first preferred embodiment of a cleaning apparatus 10 in accordance with the present invention. The cleaning apparatus 10 has a handle 12 which is attached to a base member 14. The base member has a first surface 16 and a second surface 18, a first edge 15 and a second edge 17. Preferably, the handle 12 is coupled to the first surface 16 of the base member 14.

In the preferred embodiment, handle 12 is preferably made of wood and is approximately 1" in diameter and 60" long. However, it is understood by those of ordinary skill in the art from this disclosure that the handle cross-section can vary, and can be an oval or a hexagon. Additionally, the handle 12 can be made of other materials such as steel, aluminum or fiberglass, and the length and diameter of the handle 12 may be varied to suit particular user's needs.

Referring now to FIG. 3, the handle 12 is coupled to the base member 14 by a socket 20 attached to the first surface 16 of the base member 14. Preferably, the base member 14 is rectangular and is approximately 3 inches wide and 8 inches long, and is made of a polymeric material. Hinge knuckles 21 are provided on the second edge 17 of the base member 14. In the preferred embodiment, the socket 20 has as a threaded opening (not shown), and the end of the handle 12 is configured with threads (not shown) such that the handle 12 is threadingly engaged in the socket 20. Preferably, the base member 14 and socket 20 are integrally molded from a polymeric material during manufacture. However, it is understood by those of ordinary skill in the art that the base member 14 and the socket 20 can be made of other materials such as sheet metal, aluminum or other suitable polymeric materials. It is similarly understood that the base member 14 can be of other sizes and shapes, such as an oval, if desired, and that the socket 20 may be affixed to the base member 14 in a secondary operation, such as bonding, mechanical fastening, or by other suitable means. Additionally, those of ordinary skill in the art will understand from the present disclosure that the handle 12 can be connected to the socket 20 by an interference fit, bonding, mechanical fastening, or by other suitable attachment means, if desired.

Referring now to FIGS. 1 and 3, the cleaning apparatus 10 further comprises a brush portion 22 attached to the second surface 18 of the base member 14. Preferably, the brush portion 22 comprises a brush support member 24 having a top surface 26 and a bottom surface 28. A plurality of bristles 30 are affixed to the bottom surface 28 of the brush support 24. The bristles 30 are arranged in a predetermined pattern. In the first preferred embodiment of the cleaning apparatus 10, the bristles 30 are arranged in at least one grouping 31 located in a generally centered position on the brush support member 24. As shown in FIG. 1, preferably the brush portion 22 is removably attached to the base member 14 as will be described in further detail below.

In the first preferred embodiment 10, the brush support member 24 is generally rectangular in form, and approximately the same size as the base member 14. However, it is understood by those of ordinary skill in the art from the present disclosure that the brush support member 24 can be of a different size and shape than the base member 14, if desired, without departing form the spirit and scope of the invention. Preferably, the bristles 30 have first and second ends. The first ends of the bristles 30 are permanently installed in apertures in the brush support member 24. Preferably, the bristles are made from NYLON. However, it is understood by those of ordinary skill in the art from the present disclosure that the bristles 30 may be made of other natural or synthetic materials such as stainless steel or other suitable hydrolysis resistant polymeric materials having sufficient material properties to provide aggressive cleaning action, if desired, and may be affixed to the brush support member 24 by any suitable method. Preferably, the grouping of bristles 31 is rectangular in form. However, it is understood by those of ordinary skill in the art that the grouping of bristles 31 can be arranged in any pattern, such as an oval, and that multiple, spaced groupings of bristles 30 can be used, if desired.

An absorbent material portion 34 is attached to the second surface 18 of the base member 14 proximate to the brush portion 22. The absorbent material portion 34 comprises an absorbent material support member 36 and an absorbent material 38 attached to the absorbent material support member 36. The absorbent material support member 36 has a first surface 42 and a second surface 44, and the absorbent material is preferably attached to the second surface 44. An aperture 40, having a size and shape corresponding to the size and shape of the grouping of bristles 31 of the brush portion 22, extends through the absorbent material 38 and the absorbent material support member 36.

Preferably, the absorbent material 38 is a natural or synthetic open cell sponge. The absorbent material support member 36 is preferably made of a hydrolysis resistant polymeric material having approximately the same dimensions as the brush support member 24 and the base member 14, and the absorbent material 38 is bonded with an adhesive to the absorbent material support member 36. However, it is understood it is understood by those of ordinary skill in the art from the present disclosure that the absorbent material 38 can be made from other suitable materials, such as flexible strands of yarns made from a blend of polyester and acrylic material, cotton strands, or other absorbent material, if desired. It is similarly understood that the absorbent material support member 36 may be made of aluminum or other suitable metal or polymeric materials. Additionally, those of ordinary skill in the art will recognize from the present disclosure that the absorbent material 38 may be attached to the absorbent material support member 36 by other fastening methods, such as co-molding, mechanical fastening or other suitable methods, if desired.

Referring again to FIGS. 1 and 3, preferably the absorbent material portion 34 and the brush portion 22 are removably attached to the base member 14. Preferably, two threaded studs 46 extend from the first surface 42 of the absorbent material support member 36. Aligned apertures 32, 19 are provided in the brush support member 24 and in the base member 14, respectively. Upon assembly, the studs 46 extend through the aligned apertures 32 in the brush support member 24 and the apertures 19 in the base member 14, and protrude above the first surface 16 of the base member 14. Wing nuts 48 are threadingly engaged on the studs 46 to maintain the brush portion 22 and absorbent material portion 34 in an assembled position against the base member 14 with the first surface 26 of the brush support member in contact with the second surface 18 of the base member 14 and the first surface 42 of the absorbent material support member 36 in contact with the second surface 28 of the brush support member 24. The brush portion 22 and the absorbent material portion 34 provide a generally continuous cleaning surface which is formed on the second side 18 of the base member 14 by the combination of the brush portion 22 and the absorbent material 38.

In the preferred embodiment, the studs 46 are fixed to the first surface 42 of the absorbent material support 36. However, it is understood by those of ordinary skill in the art from the present disclosure that the studs 46 could be replaced by other fastening means such as threaded fasteners inserted through holes in the absorbent material 38 and the absorbent material support member 36 or various types of other removable fasteners such as spring clips or the like. It is similarly understood that the base member 14, brush support member 24 and absorbent material support member 36 could be integrally formed as a single unit (not shown) and it is not necessary that the brush portion 22 and the absorbent material portion 34 be disassemblable from the base member 14. Alternatively, the brush portion 22 and the absorbent material portion 34 can be combined on a single support member (not shown) and the single support member containing both the brush portion and the absorbent material portion can be attached to the base member 14.

Referring again to FIGS. 1 and 3, a wringer 50 is mounted for pivotal movement with respect to the base member 14. Preferably, the wringer includes a perforated platen 52, having a plurality of small apertures 54 defined therethrough, and an attached handle 56. A first edge of the platen 52 is configured with hinge knuckles 58 which are interspaced between the hinge knuckles 21 on the first edge of the base member 14. A pintle 60 is inserted through the apertures in the aligned hinged knuckles 58 and 21 of the platen 52 and the base member 14, respectively, to provide the pivotal connection. An aperture 62 having a size and shape corresponding to the size and shape of the brush portion 22, extends through the wringer 50 in a position corresponding to the location of the grouping 31 of bristles 30 on the brush portion 22.

The wringer 50 can be pivoted from a first, storage position, as shown in FIGS. 1 and 3 in which the wringer 50 is generally parallel to the handle 12, to a second position (not shown) in which the wringer 50 is in contact with the absorbent material 38, in a position substantially parallel with the base member 14. The wringer 50 is configured to substantially engage and squeeze moisture from the absorbent material portion 38 without engaging the brush portion 22.

In the preferred embodiment, the wringer 50 is molded from a hydrolysis resistant polymeric material with the platen 52, the handle 56 and the hinge knuckles 58 formed as an integral structure. The size of the platen 52 is generally approximately the same size as the absorbent material 38, and the aperture 62 through the platen 52 is slightly greater than the size of the at least one grouping 31 of bristles 30 to compensate for the pivotal movement of the wringer 50 such that it clears the brush portion 22. However, it is understood by those of ordinary skill in the art from the present disclosure that the wringer 50 may be made of other suitable materials, such as metal or other polymeric materials, and the platen 52 and the handle may be made separately and joined together in a subsequent manufacturing operation. Additionally, the hinge knuckles 58 and 21 need not be integrally formed with the wringer 50 and the base member 14, and a separate hinge (not shown) could be used to pivotally attach the wringer 50 to the base member 14. It is similarly recognized by those of ordinary skill in the art that the wringer 50 may be stored in any position which leaves the cleaning surface formed by the brush portion 22 and the absorbent material portion 34 exposed.

In the preferred embodiment, the wringer 50 is stored in a generally parallel position to the handle 12 with a clip 64 holding the wringer handle 56 adjacent to the cleaning apparatus handle 12. However, it is recognized by those of ordinary skill in the art from the present disclosure that the wringer 50 can be stored in various positions above the first surface of the base member 14.

Having described the structure of the first embodiment of the cleaning apparatus 10 in accordance with the present invention, a brief description of its use follows.

A user first inserts the base member 14, brush portion 22 and absorbent material portion 34 into a bucket of cleaning fluid (not shown) generally comprised of a detergent and water. The absorbent material portion 34 absorbs the cleaning fluid. The base member 14, brush portion 22 and absorbent material portion 34 of the cleaning apparatus 10 are then withdrawn from the bucket, and the user moves the cleaning apparatus 10 back and forth across an area of the floor to spread the cleaning fluid on the floor. The bristles 30 of the brush portion 22 scrub the floor to remove ground in dirt. The user then places the base member 14, brush portion 22 and absorbent material portion 34 of the cleaning apparatus 10 in the bucket to rinse accumulated dirt and debris from the absorbent material portion 34. Next the user removes the base member 14, brush portion 22 and the absorbent material portion 34 of the cleaning apparatus 10 from the cleaning fluid, and grasps the wringer handle 56, disengaging it from the storage clip 64. Then, utilizing the wringer handle 56, the user pivots the wringer 50 about the hinge formed by the hinge knuckles 58 on the wringer 50 and the hinge knuckles 21 on the base member 14 from the first storage position, in which the wringer 50 is generally parallel with the handle 12 of the cleaning apparatus 10, to a second position, in which the wringer 50 engages the absorbent material 38 of the absorbent material portion 34. As the user applies pressure to the handle 56, the absorbent material 38 of the absorbent material portion 34 is compressed by the platen 52 of the wringer 50 such that the wringer 50 moves to a second position, in which the wringer 50 is substantially parallel to the base member 14. As the wringer 50 is moved toward the second position, moisture is squeezed from the absorbent material 38 of the absorbent material portion 34 without the wringer 50 engaging the grouping 31 of bristles 30 of the brush portion 22, which passes through the aperture 62 in the wringer 50. The wringer 50 is then pivoted back to the first position, and the wringer handle 56 is engaged in the clip 64 on the cleaning apparatus handle 12. The user then moves the brush portion 22 and the absorbent material portion 34 back and forth across the area of the floor which was previously coated with the cleaning fluid to absorb the cleaning fluid and remove and loosen dirt. As the cleaning apparatus 10 is moved back and forth across the floor, the grouping 31 of bristles 30 of the brush portion 22 scrub the floor to remove ground-in dirt. The cleaning fluid and any dissolved dirt is absorbed by the absorbent material 38 of the absorbent material portion 34. The base member 14, brush portion 22 and the absorbent material portion 34 are then held over the bucket, and the wringer 50 is used to remove moisture from the absorbent material 38 of the absorbent material portion 34 in the above-described manner. This process is repeated until the entire floor is clean.

Figure 4:
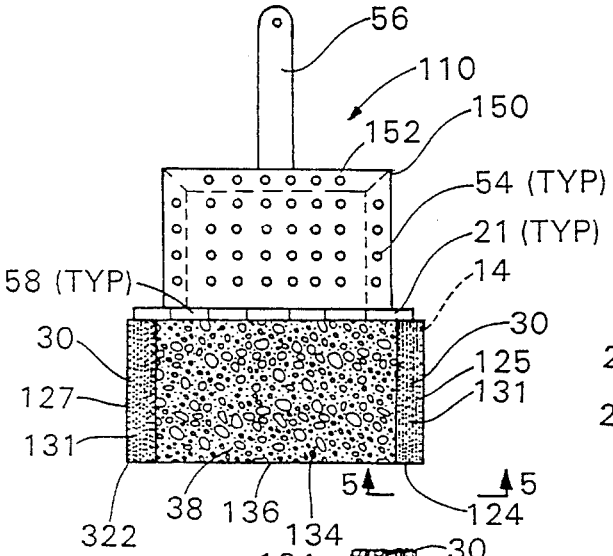
FIG. 4 is a bottom plan view of a second embodiment of a cleaning apparatus in accordance with the present invention with the wringer shown.
Figure 5:
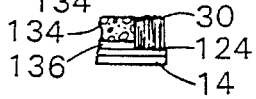
FIG. 5 is a section view taken along line 5—5 in FIG. 4.

Referring now to FIGS. 4 and 5, a second embodiment of a cleaning apparatus 110 in accordance with the present invention is shown. The second preferred embodiment of the cleaning apparatus 110 is similar to the first preferred embodiment 10 and identical elements have been identified with the same reference numerals, and similar elements have been identified with similar reference numerals having the prefix "1". For example, the wringer 150 of the second embodiment is similar to the wringer 50 of the first embodiment. Accordingly, reference numerals have been provided on all of the illustrated elements for clarity, and a description of the differences from the first embodiment 10 described above follows.

As shown in FIGS. 4 and 5, the cleaning apparatus 110 is shown with the wringer 150 in a position between the first and second positions, as described above, in a plane parallel to the base member 14. The wringer 150 is pivotally attached to the base member 14 by hinge knuckles 21 on the base member 14 and hinge knuckles 58 on the wringer 150, in the manner previously described above in connection with the first embodiment 10. The pivotal attachment of the wringer 150 defines an axis, and the brush support member 124 has two opposite edges 125 and 127 which are approximately normal to the wringer attachment axis. The bristles 30 are arranged in at least one grouping 131 along each of the two opposite edges 125 and 127 of the brush support member 124 and are spaced apart by predetermined distance.

The absorbent material 38 of the absorbent material portion 134, the absorbent material support member 136 and the wringer 150 each have a length which is at least slightly less than the distance between the groupings 131 of bristles 30 along the two opposite edges 125, 127 of the brush support member 124, such that the wringer 150 can engage the absorbent material 38 of the absorbent material portion 134 without engaging the groupings 131 of bristles 30 along the two opposite edges 125 and 127 of the brush support member 124. Preferably, the position of the studs 46 on the absorbent material support member 136 and the apertures in the brush support member 124 are the same as in the first embodiment 10 such that different sets of brush portions 22, 122 and absorbent material portions 34, 134 can be attached to the same base member 14, if desired.

The use of the second embodiment of the cleaning apparatus 110 is the same as the first embodiment 10. Providing the bristle groupings 131 along the two opposite ends 125 and 127 of the base member 124 provides a user with the ability to scrub in corners and along edges with the groupings 131 of bristles 30.

Figure 6:
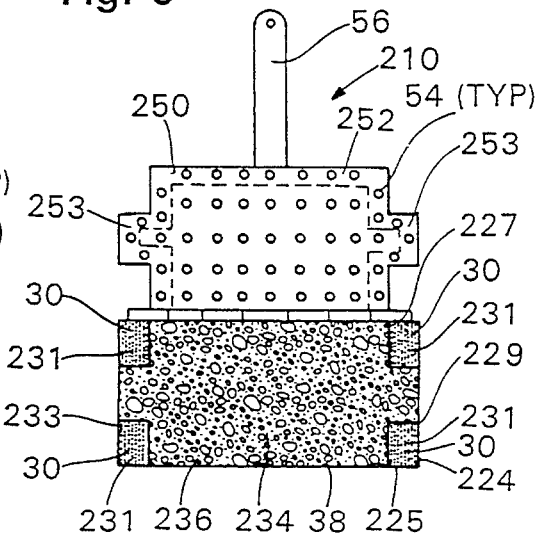
FIG. 6 is a bottom plan view of a third embodiment of a cleaning apparatus in accordance with the present invention with the wringer shown.

Referring now to FIG. 6, a third preferred embodiment of a cleaning apparatus 210 in accordance with the present invention is shown. The third preferred embodiment 210 is similar to the second preferred embodiment and identical elements have been identified with the same reference numerals and similar elements have been identified with like reference numerals having the prefix "2". For example, in the third preferred embodiment, the wringer 250 is similar to the wringer 150 of the second preferred embodiment. Accordingly, reference numerals have been provided on all of the illustrated elements for clarity, and a description of the differences from the second embodiment 110 described above follows.

As shown in FIG. 6, the third preferred embodiment of the cleaning apparatus 210 is shown with the wringer 250 in a position between the first and second positions, as described above, in a plane parallel to the base member 14. The cleaning apparatus 210 includes a brush support member 224 having a first edge 225, a second edge 227, a third edge 229 and a fourth edge 233. The bristles 30 are arranged in at least four groupings 231 at the four outer corners of the brush support member 224, with the first grouping 231 of bristles 30 being located along the third edge 229 of the brush support member 224 in close proximity to the first edge 225 of the brush support member 224. The second grouping 231 of bristles 30 is located along the third edge 229 of the brush support member 224 in close proximity to the second edge 227 of the brush support member 224. The third grouping 231 of bristles 30 is located along the fourth edge 233 of the brush support member 224 in close proximity to the first edge 225 of the brush support member 224. The fourth grouping 231 of bristles 30 is located along the fourth edge 233 of the brush support member in close proximity to the second edge 227 of the brush support member 224. The absorbent material 38 of the absorbent material portion 234 and the absorbent material support member 236 are located between the four groupings 231 of bristles 30. Preferably, the platen 252 of the wringer 250 is configured such that the platen 252 has two projections 253 which contact the absorbent material 38 between the groupings 231 of bristles 30 along the first and second edges 225 and 227 of the brush support member 224.

The use of the cleaning apparatus 210 in accordance with the third preferred embodiment of the present invention is similar to the first and second preferred embodiments 10 and 110 described above, and accordingly, further description is not required. Providing four groupings 231 of bristles 30 allows a user to scrub in corners and along edges.

Figure 7:
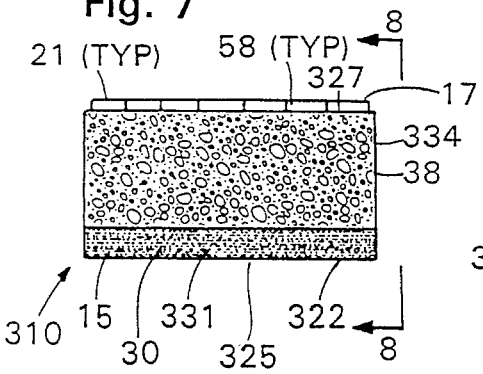
FIG. 7 is a bottom plan view of a fourth embodiment of a cleaning apparatus in accordance with the present invention.
Figure 8:
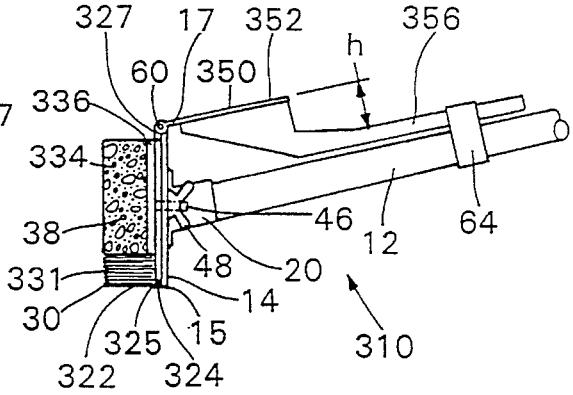
FIG. 8 is a side view taken along lines 8—8 in FIG. 7.

Referring now to FIGS. 7 and 8, a fourth preferred embodiment 310 of the present invention is shown. The fourth preferred embodiment is similar to the first, second and third embodiments of the cleaning apparatus 10, 110 and 210 and identical elements have been identified with the same reference numerals and similar elements have been identified with similar reference numerals including the prefix "3". For example, the wringer 350 of the fourth preferred embodiment 310 is similar to the wringer 250 of the third preferred embodiment 210. A description of the differences from the third preferred embodiment 210 is provided below.

As shown in FIGS. 7 and 8, the cleaning apparatus 310 in accordance with the fourth preferred embodiment of the present invention includes a base member 14 as previously described in connection with the first, second and third embodiments 10, 110 and 210. The wringer 350 is pivotally attached to the base member 14 along the second edge 17 in the manner previously described above. The brush support member 324 has a first edge 325 and a second edge 327 which are located in a position to correspond with the first and second edges 15 and 17 of the base member 14, respectively. The bristles 30 are arranged in at least one grouping 331 along the first edge 325 of the brush support member 324. The absorbent material 38 of the absorbent material portion 334, the absorbent material support member 336 and the wringer 350 each have a width which is at least slightly less than a distance between the second edge of the base member 14 and the grouping 331 of bristles 30 on the front edge 325 of the brush support member 324.

Referring now to FIG. 8, the wringer handle 356 is provided with an offset h between the wringer handle 356 and the platen 352, such that the platen 352 can engage and squeeze the absorbent material 38 of the absorbent material portion 334 without contacting the grouping 331 of bristles 30.

The use of the fourth preferred embodiment of the cleaning apparatus 310 is similar to the first, second and third preferred embodiments of the cleaning apparatus 10, 110 and 210.

Figure 9:
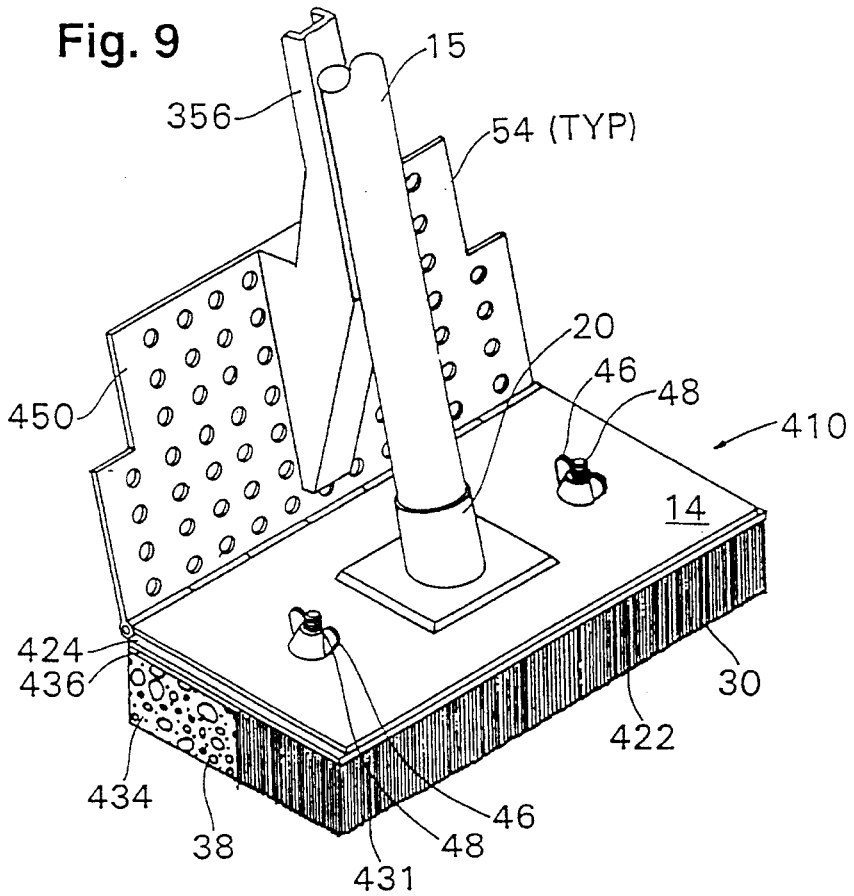
FIG. 9 is a perspective view of fifth embodiment of a cleaning apparatus in accordance with the present invention.
Figure 10:
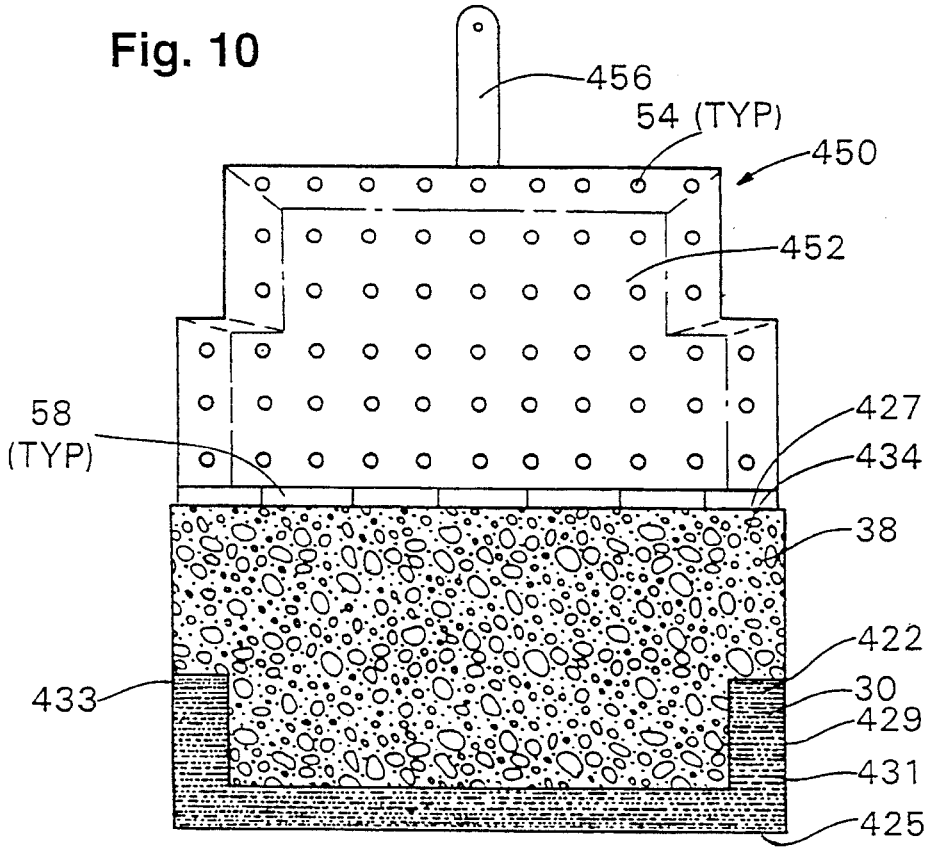
FIG. 10 is a bottom plan view of the cleaning apparatus of FIG. 9.

Referring now to FIGS. 9 and 10, a fifth preferred embodiment of a cleaning apparatus 410 in accordance with the present invention is shown. The cleaning apparatus 410 in accordance with the fifth preferred embodiment is similar to the fourth preferred embodiment 310 and identical reference numerals have been used to identify identical elements and similar reference numerals having the prefix "4" have been used to identify similar elements. For example, the wringer 450 of the fifth preferred embodiment 410 is similar to the wringer 350 of the fourth preferred embodiment 310. A description of the differences from the fourth preferred embodiment 310 follows.

As shown in FIGS. 9 and 10, the brush support member 424 has as first edge 425, and second edge 427, a third edge 429 and a fourth edge 433. The bristles 30 are arranged in at least one grouping 431 along the first edge 425 of the brush support member 424 and the grouping 431 of bristles 30 extends at least partially along the third and fourth edges 429 and 433 of the brush support member 424. The absorbent material 38 of the absorbent material portion 434, the absorbent material support member 436 and the wringer have a complementary profile to the grouping 431 of bristles 30. The platen 452 of the wringer 450 (shown in an intermediate position in FIG. 10) can be pivoted from a first, storage position, generally parallel to the cleaning apparatus handle 12, as shown in FIG. 9, to a second position, in which the wringer 450 is substantially parallel to the base member 14, with the wringer 450 being configured to substantially engage and squeeze moisture from the absorbent material 38 of the absorbent material portion 434 without engaging the brush portion 422.

The use of the cleaning apparatus 410 is similar to that described above in accordance with the previous embodiments.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A cleaning apparatus comprising:

a handle;

a base member having a first surface and a second surface, the handle being coupled to the first surface of the base member;

a brush portion attached to the second surface of the base member, the brush portion comprising a brush support member having a top surface and a bottom surface, and a plurality of bristles affixed to the bottom surface of the brush support member, the bristles being arranged in a predetermined pattern;

an absorbent material portion, including absorbent material attached to an absorbent material support member, attached to the second surface of the base member proximate the brush portion, whereby a generally continuous cleaning surface is formed on the second surface of the base member by a combination of the brush portion and the absorbent material; and a wringer mounted for pivotal movement with respect to the base member such that the wringer can be pivoted from a first, storage position, generally parallel with the handle, to a second position, in which the wringer is substantially parallel with the base member, the wringer being configured to substantially engage and squeeze moisture from the absorbent material without engaging the brush portion, the bristles being arranged in at least one grouping located in a generally centered position on the brush support member and at least one aperture having a size and shape corresponding to the shape and size of the at least one grouping of bristles of the brush portion extends through the absorbent material, the absorbent material support member and the wringer in a position corresponding to the location of the at least one grouping of bristles.

2. A cleaning apparatus comprising:

a handle;

a base member having a first surface and a second surface, the handle being coupled to the first surface of the base member;

a brush portion attached to the second surface of the base member, the brush portion comprising a brush support member having a top surface and a bottom surface, and a plurality of bristles affixed to the bottom surface of the brush support member, the bristles being arranged in a predetermined pattern;

an absorbent material portion, including absorbent material attached to an absorbent material support member, attached to the second surface of the base member proximate the brush portion, whereby a generally continuous cleaning surface is formed on the second surface of the base member by a combination of the brush portion and the absorbent material; and a wringer mounted for pivotal movement with respect to the base member such that the wringer can be pivoted from a first, storage position, generally parallel with the handle, to a second position, in which the wringer is substantially parallel with the base member, the wringer being configured to substantially engage and squeeze moisture from the absorbent material without engaging the brush portion, the pivotal attachment of the wringer defining an axis, the brush support member having two opposite edges which are approximately normal to the wringer attachment axis and the bristles are arranged in at least one grouping along each of the two opposite edges of the brush support member and are spaced apart by a predetermined distance, the absorbent material, the absorbent material support member and the wringer each having a length which is at least slightly less than the distance between the groupings of bristles.

3. A cleaning apparatus comprising:

a handle;

a base member having a first surface and a second surface, the handle being coupled to the first surface of the base member;

a brush portion attached to the second surface of the base member, the brush portion comprising a brush support member having a top surface and a bottom surface, and a plurality of bristles affixed to the bottom surface of the brush support member, the bristles being arranged in a predetermined pattern;

an absorbent material portion, including absorbent material attached to an absorbent material support member, attached to the second surface of the base member proximate the brush portion, whereby a generally continuous cleaning surface is formed on the second surface of the base member by a combination of the brush portion and the absorbent material; and a wringer mounted for pivotal movement with respect to the base member such that the wringer can be pivoted from a first, storage position, generally parallel with the handle, to second position, in which the wringer is substantially parallel with the base member, the wringer being configured to substantially engage and squeeze moisture from the absorbent material without engaging the brush portion, the brush support member having a first edge, a second edge, a third edge and a fourth edge, the bristles being arranged in at least four groupings, the first grouping of bristles being located along the third edge of the brush support member in close proximity to the first edge of the brush support member, the second grouping of bristles being located along the third edge of the brush support member in close proximity to the second edge of the brush support member, the third grouping of bristles being located along the fourth edge of the brush support member in close proximity to the first edge of the brush support member and the fourth grouping of bristles being located along the fourth edge of the brush support member in close proximity to the second edge of the brush support member, the absorbent material and the absorbent material support member being located between the groupings of bristles.

4. A cleaning apparatus comprising:

a handle;

a base member having a first surface and a second surface, the handle being coupled to the first surface of the base member;

a brush portion attached to the second surface of the base member, the brush portion comprises a brush support member having a top surface and a bottom surface, and a plurality of bristles affixed to the bottom surface of the brush support member, the bristles being arranged in a predetermined pattern;

an absorbent material portion, including absorbent material attached to an absorbent material support member, attached to the second surface of the base member proximate the brush portion, whereby a generally continuous cleaning surface is formed on the second surface of the base member by a combination of the brush portion and the absorbent material; and a wringer mounted for pivotal movement with respect to the base member such that the wringer can be pivoted from a first, storage position, generally parallel with the handle, to a second position, in which the wringer is substantially parallel with the base member, the wringer being configured to substantially engage and squeeze moisture from the absorbent material without engaging the brush portion, the base member has a first edge and a second edge, and the wringer being pivotally attached to the base member along the second edge of the base member, the brush support member has a first edge and a second edge which are located in a position to correspond with the first and second edges of the base member, respectively, the bristles being arranged in at least one grouping along the first edge of the brush support member, and the absorbent material, the absorbent material support member and the wringer each have a width which is at least slightly less than a distance between the second edge of the base member and the at least one grouping of bristles on the first edge of the brush support member, the handle being inclined at an acute angle with respect to the base member toward the second edge and extending past the second edge such that the first edge and the grouping of bristles are located at a forward edge of the cleaning apparatus.

5. A cleaning apparatus comprising:

a handle;

a base member having a first surface and a second surface, the handle being coupled to the first surface of the base member;

a brush portion having a brush support member and a plurality of bristles affixed to the brush support member, the brush support member having a first surface and a second surface, the bristles being arranged in a predetermined pattern on the second surface, the brush portion being attached to the base member with the first surface of the brush support member being in opposed facing relation to the second surface of the base member;

absorbent material portion having an absorbent material support member and absorbent material attached to the absorbent material support member, the absorbent material portion being attached to the base member proximate the brush portion, whereby a generally continuous cleaning surface is formed on the second surface of the base member by a combination of the bristles and the absorbent material; and a wringer mounted for pivotal movement with respect to the base member such that the wringer can be pivoted from a first, storage position, away from the second surface of the base member, to a second position in which the wringer is substantially parallel with the base member, the wringer being configured to substantially engage and squeeze moisture from the absorbent material without engaging the brush portion, the base member having a first edge and a second edge, and the wringer being pivotally attached to the base member along the second edge of the base member, the brush support member having a first edge and a second edge which are located in a position to correspond with the first and second edges of the base member, respectively, the bristles being arranged in at least one grouping along the first edge of the brush support member, and the absorbent material, the absorbent material support member and the wringer each having a width which is at least slightly less than a distance between the second edge of the base member and the at least one grouping of bristles on the first edge of the brush support member, the handle being inclined at an acute angle with respect to the base member toward the second edge and extending past the second edge such that the first edge and the grouping of bristles are located at a forward edge of the cleaning apparatus.

* * * * *